US010405125B2

(12) United States Patent
Family et al.

(10) Patent No.: US 10,405,125 B2
(45) **Date of Patent: *Sep. 3, 2019**

(54) SPATIAL AUDIO RENDERING FOR BEAMFORMING LOUDSPEAKER ARRAY

(71) Applicant: Apple Inc., Cupertino, CA (US)

(72) Inventors: Afrooz Family, Emerald Hills, CA (US); Mitchell R. Lerner, San Francisco, CA (US); Sylvain J. Choisel, Palo Alto, CA (US); Tomlinson Holman, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/593,887

(22) Filed: May 12, 2017

(65) Prior Publication Data

US 2018/0098171 A1 Apr. 5, 2018

Related U.S. Application Data

(60) Provisional application No. 62/402,836, filed on Sep. 30, 2016.

(51) Int. Cl.
*H04R 5/02* (2006.01)
*H04S 7/00* (2006.01)
(Continued)

(52) U.S. Cl.
CPC ..... *H04S 7/303* (2013.01); *H04R 1/403* (2013.01); *H04R 5/02* (2013.01); *H04R 5/04* (2013.01);
(Continued)

(58) Field of Classification Search
CPC ..... H04S 7/303; H04S 7/301; H04S 2400/13; H04S 5/00; H04S 5/005; H04S 1/002;
(Continued)

(56) References Cited

U.S. PATENT DOCUMENTS 7,092,541 B1 8/2006 Eberbach
7,433,483 B2 10/2008 Fincham
(Continued)

FOREIGN PATENT DOCUMENTS

JP H05153698 A 6/1993
KR 20150038487 A 4/2015
(Continued)

OTHER PUBLICATIONS

Antonacci, Fabio, et al., "Soundfield Rendering with Loudspeaker Array Through Multiple Beam Shaping", *2009 IEEE Workshop on Applications of Signal Processing to Audio and Acoustics*, (Oct. 18-21, 2009), 5 pages.
(Continued)

*Primary Examiner* — Leshui Zhang
(74) *Attorney, Agent, or Firm* — Womble Bond Dickinson (US) LLP

(57) ABSTRACT

A process for reproducing sound using a loudspeaker array that is housed in a loudspeaker cabinet includes the selection of a number of sound rendering modes and changing the selected sound rendering mode based on changes in one or both of sensor data and a user interface selection. The sound rendering modes include a number of mid-side modes and at least one direct-ambient mode. Other embodiments are also described and claimed.

19 Claims, 3 Drawing Sheets

(51) Int. Cl.
*H04R 1/40* (2006.01)
*H04R 5/04* (2006.01)
*H04S 3/00* (2006.01)

(52) U.S. Cl.
CPC ..... *H04S 3/008* (2013.01); *H04S 7/305* (2013.01); *H04S 2400/01* (2013.01)

(58) Field of Classification Search
CPC .... H04S 7/00; H04S 7/30; H04R 5/02; H04R 1/40; H04R 1/02; H04R 9/06; H04R 5/00; G06F 3/017; G06F 17/3074; G06F 17/30743; G06F 17/30749; G06F 17/30752; G06F 17/30755; G06F 17/30761; G06F 17/30766; G06F 17/30775; G06F 3/16; G06F 3/162; G06F 3/167; G10H 2240/051; G10H 2240/056; G10H 2240/061; G10H 2240/066; G10H 2240/071; G10H 2210/031; G10H 2210/041; G10H 2210/046; G10H 2210/051; G10H 2210/056; G10H 2210/061; G10H 2210/295; G10H 2210/301; G10H 2210/305; H03F 3/68; H03G 3/3005; H03G 3/301; H03G 3/3026; H03G 3/3031; G11B 20/00007
USPC ..... 381/300–308, 336, 335, 182, 77–86, 22, 381/23, 71.1–71.12, 17, 120; 700/94; 704/278; 707/104.1
See application file for complete search history.

(56) References Cited

U.S. PATENT DOCUMENTS 7,515,719 B2 4/2009 Hooley et al.
7,577,260 B1 8/2009 Hooley et al.
9,055,371 B2 6/2015 Tammi et al.
2002/0067835 A1 6/2002 Vatter
2003/0007648 A1 1/2003 Currell
2005/0152557 A1 7/2005 Sasaki et al.
2006/0050907 A1* 3/2006 Levitsky ..... H04R 1/345 381/304
2006/0165247 A1 7/2006 Mansfield et al.
2007/0217621 A1* 9/2007 Takumai ..... H04R 3/12 381/80
2007/0253575 A1* 11/2007 Melanson ..... H04R 3/12 381/97
2007/0263888 A1* 11/2007 Melanson ..... H04S 3/00 381/300
2007/0269071 A1* 11/2007 Hooley ..... H04R 1/403 381/336
2007/0286427 A1* 12/2007 Jung ..... H04S 3/002 381/17
2008/0181416 A1* 7/2008 Jung ..... H04R 1/403 381/2
2008/0212805 A1 9/2008 Fincham
2009/0060236 A1* 3/2009 Johnston ..... H04R 3/12 381/304
2010/0329489 A1* 12/2010 Karaoguz ..... H04S 7/302 381/307
2011/0002488 A1* 1/2011 Van Daele ..... H04R 5/02 381/307
2011/0051937 A1* 3/2011 Ma ..... H04R 5/02 381/17
2014/0270274 A1* 9/2014 Cohen ..... H02K 41/03 381/182
2014/0277650 A1* 9/2014 Zurek ..... H04R 3/00 700/94
2015/0304789 A1* 10/2015 Babayoff ..... H04R 1/403 381/303
2015/0350804 A1* 12/2015 Crockett ..... H04R 5/02 381/307
2016/0134986 A1* 5/2016 Liu ..... H04R 1/403 381/303
2016/0336022 A1* 11/2016 Florencio ..... G10K 11/002

FOREIGN PATENT DOCUMENTS

WO WO2016/048381 3/2016
WO WO-2016048381 A1 * 3/2016

OTHER PUBLICATIONS

Chun, Chan Jun, et al., "Real-Time Conversion of Stereo Audio to 5.1 Channel Audio for Providing Realistic Sounds", *International Journal of Signal Processing, Image Processing and Pattern Recognition*, vol. 2, No. 4, (Dec. 2009), 85-94.
Heegaard, Frederick D., et al., "The Reproduction of Sound in Auditory Perspective and a Compatible System of Stereophony", *J. Audio Eng. Soc.*, vol. 40, No. 10, (Oct. 1992), 802-808.
Orban, Robert, "The Stereo Synthesizer and Stereo Matrix: New Techniques for Generating Stereo Space", Presented at the 38th Convention, An Audio Engineering Society Reprint, (May 4-7, 1970), 7 pages.
Scarpelli, Paul, "Dipole vs Bipole vs Monopole: Which Surround Speaker is Best?", *Audioholics: Online A/V Magazine*, Retrieved from the Internet: <http://www.audioholics.com/loudspeaker-design/surround-speaker-dipole-vs-bipole>; Originally published Mar. 31, 2015, (Sep. 20, 2015), 10 pages.
Thiel, Ryan D., "Array Processing Techniques for Broadband Acoustic Beamforming", *University of New Orleans These and Dissertations*, (May 20, 2005), 44 pages.
Williams, Michael I.Y., et al., "Generalized Broadband Beamforming Using a Modal Subspace Decomposition", *EURASIP Journal on Advances in Signal Processing*, vol. 2007, Article ID 68291, (Jan. 2007), 11 pages.
Japanese Office Action dated Oct. 12, 2018 for related Japanese Appln No. 2017-156885 3 Pages.
European search Report and Written Opinion dated Sep. 1, 2017 for related EP appln No. 17186626.2-1901 8 Pages.
Australian Examination Report dated Jun. 4, 2018 for related AU Appln. No, 2017216541 3 Pages.
Korean Office Action dated Aug. 22, 2018 for related Korean Appln No. 10-2017-0104194 10 Pages.
Japanese Office Action dated Oct. 22, 2018 for related Japanese Appln No. 2017-156885 3 Pages.

* cited by examiner

SPATIAL AUDIO RENDERING FOR BEAMFORMING LOUDSPEAKER ARRAY

This application claims the benefit of the earlier filing date of co-pending U.S. Provisional Patent Application No. 62/402,836, filed Sep. 30, 2016.

FIELD

An embodiment of the invention relates to spatially selective rendering of audio by a loudspeaker array for reproducing stereophonic recordings in a room. Other embodiments are also described.

BACKGROUND

Much effort has been spent on developing techniques that are intended to reproduce a sound recording with improved quality, so that it sounds as natural as in the original recording environment. The approach is to create around the listener a sound field whose spatial distribution more closely approximates that of the original recording environment. Early experiments in this field have revealed for example that playing a music signal through a loudspeaker in front of a listener and a slightly delayed version of the same signal through a loudspeaker that is behind the listener gives the listener the impression that he is in a large room and music is being played in front of him. The arrangement may be improved by adding a further loudspeaker to the left of the listener and another to his right, and feeding the same signal to these side speakers with a delay that is different than the one between the front and rear loudspeakers.

A stereophonic recording captures a sound environment by simultaneously recording from at least two microphones that have been strategically placed relative to the sound sources. During playback of these (at least two) input audio channels through respective loudspeakers, the listener is able to (using perceived, small differences in timing and sound level) derive roughly the positions of the sound sources, thereby enjoying a sense of space. In one approach, a microphone arrangement may be selected that produces two signals, namely a mid signal that contains the central information, and a side signal that starts at essentially zero for a centrally located sound source and then increases with angular deviation (thus picking up the "side" information.) Playback of such mid and side signals may be through respective loudspeaker cabinets that are adjoining and oriented perpendicular to each other, and these could have sufficient directivity to in essence duplicate the pickup by the microphone arrangement.

Loudspeaker arrays such as line arrays have been used for large venues such as outdoors music festivals, to produce spatially selective sound (beams) that are directed at the audience. Line arrays have also been used in closed, large spaces such as houses of worship, sports arenas, and malls.

SUMMARY

An embodiment of the invention aims to render audio with both clarity and immersion or a sense of space, within a room or other confined space, using a loudspeaker array. The system has a loudspeaker cabinet in which are integrated a number of drivers, and a number of audio amplifiers are coupled to the inputs of the drivers. A rendering processor receives a number of input audio channels (e.g., left and right of a stereo recording) of a piece of sound program content such as a musical work, that is to be converted into sound by the drivers. The rendering processor has outputs that are coupled to the inputs of the amplifiers over a digital audio communication link. The rendering processor also has a number of sound rendering modes of operation in which it produces individual signals for the inputs of the drivers. Decision logic (a decision processor) is to receive, as decision logic inputs, one or both of sensor data and a user interface selection. The decision logic inputs may represent, or may be defined by, a feature of a room (e.g., in which the loudspeaker cabinet is located), and/or a listening position (e.g., location of a listener in the room and relative to the loudspeaker cabinet.) Content analysis may also be performed by the decision logic, upon the input audio channels. Using one or more of content analysis, room features (e.g., room acoustics), and listener location or listening position, the decision logic is to then make a rendering mode selection for the rendering processor, in accordance with which the loudspeakers are driven during playback of the piece of sound program content. The rendering mode selection may be changed, for example automatically during the playback, based on changes in the decision logic inputs.

The sound rendering modes include a number of first modes (e.g., mid-side modes), and one or more second modes (e.g., ambient-direct modes). The rendering processor can be configured into any one of the first modes, or into the second mode. In one embodiment, in each of the mid-side modes, the loudspeaker drivers (collectively being operated as a beamforming array) produce sound beams having a principally omnidirectional beam (or bean pattern) superimposed with a directional beam (or beam pattern).

In the ambient-direct mode, the loudspeaker drivers produce sound beams having i) a direct content pattern that is aimed at the listener location and is superimposed with ii) an ambient content pattern that is aimed away from the listener location. The direct content pattern contains direct sound segments (e.g., a segment containing direct voice, dialogue or commentary, that should be perceived by the listener as coming from a certain direction), taken from the input audio channels. The ambient content pattern contains ambient or diffuse sound segments taken from the input audio channels (e.g., a segment containing rainfall or crowd noise that should be perceived by the listener as being all around or completely enveloping the listener.) In one embodiment, the ambient content pattern is more directional than the direct content pattern, while in other embodiments the reverse is true.

The capability of changing between multiple first modes and the second mode enables the audio system to use a beamforming array, for example in a single loudspeaker cabinet, to render music clearly (e.g., with a high directivity index for audio content that is above a lower cut-off frequency that may be less than or equal to 500 Hz) as well as being able to "fill" a room with sound (with a low or negative directivity index perhaps for the ambient content reproduction). Thus, audio can be rendered with both clarity and immersion, using, in one example, a single loudspeaker cabinet for all content, e.g., that is in some but not all of the input audio channels or that is in all of the input audio channels, above the lower cut-off frequency.

In one embodiment, content analysis is performed upon the input audio channels, for example, using timed/windowed correlation, to find correlated content and uncorrelated content. Using a beamformer, the correlated content may be rendered in the direct content beam pattern, while the uncorrelated content is simultaneously rendered in one or more ambient content beams. Knowledge of the acoustic interactions between the loudspeaker cabinet and the room (which may be based in part on decision logic inputs that may describe the room) can be used to help render any ambient content. For example, when a determination is made that the loudspeaker cabinet is placed close to an acoustically reflective surface, knowledge of such room acoustics may be used to select the ambient-direct mode (rather than any of the mid-side modes) for rendering the piece of sound program content.

In other cases of listener location and room acoustics, such as when the loudspeaker cabinet is positioned away from any sound reflective surfaces, one of the mid-side modes may be selected to render the piece of sound program content. Each of these may be described as an "enhanced" omnidirectional mode, where audio is played consistently across 360 degrees while also preserving some spatial qualities. A beam former may be used that can produce increasingly higher order beam patterns, for example, a dipole and a quadrupole, in which decorrelated content (e.g., derived from the difference between the left and right input channels) is added to or superimposed with a monophonic main beam (essentially an omnidirectional beam having a sum of the left and right input channels).

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments of the invention with reference to the appended drawings are now explained. Whenever the shapes, relative positions and other aspects of the parts described in the embodiments are not explicitly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
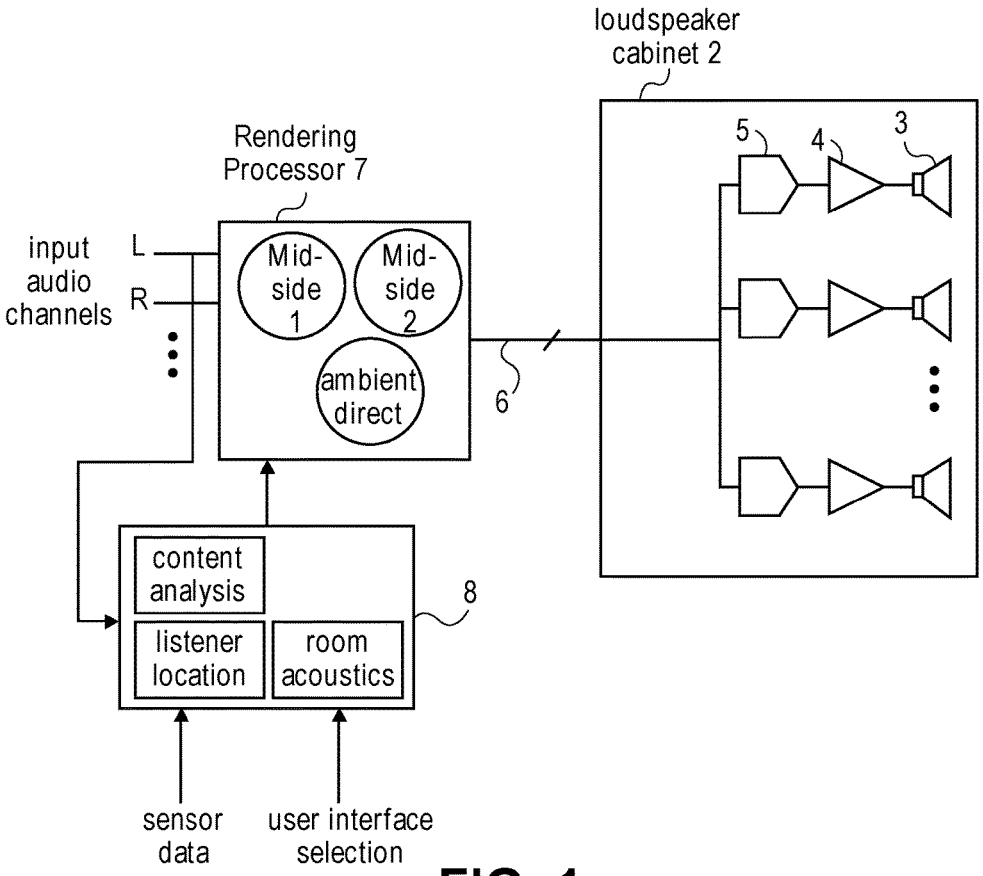
FIG. 1 is a block diagram of an audio system having a beamforming loudspeaker array.
Figure 2A:
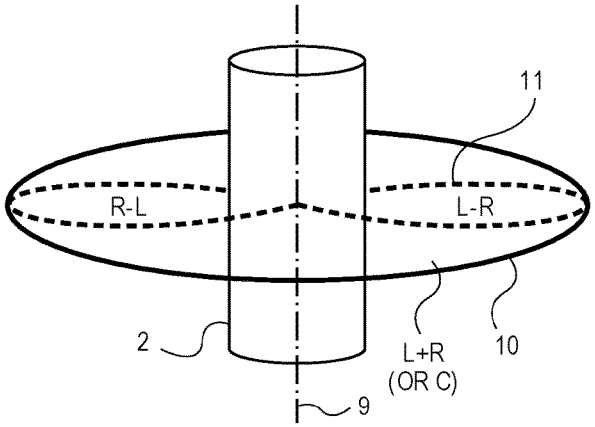
FIG. 2A is an elevation view of sound beams produced in a mid-side rendering mode.

FIG. 1 is a block diagram of an audio system having a beamforming loudspeaker array that is being used for playback of a piece of sound program content that is within a number of input audio channels. A loudspeaker cabinet 2 (also referred to as an enclosure) has integrated therein a number of loudspeaker drivers 3 (numbering at least 3 or more and, in most instances, being more numerous than the number of input audio channels). In one embodiment, the cabinet 2 may have a generally cylindrical shape, for example, as depicted in FIG. 2A and also as seen in the top view in FIG. 5, where the drivers 3 are arranged side by side and circumferentially around a center vertical axis 9. Other arrangements for the drivers 3 are possible. In addition, the cabinet 2 may have other general shapes, such as a generally spherical or ellipsoid shape in which the drivers 3 may be distributed evenly around essentially the entire surface of the sphere. The drivers 3 may be electrodynamic drivers, and may include some that are specially designed for different frequency bands including any suitable combination of tweeters and midrange drivers, for example.

The loudspeaker cabinet 2 in this example also includes a number of power audio amplifiers 4 each of which has an output coupled to the drive signal input of a respective loudspeaker driver 3. Each amplifier 4 receives an analog input from a respective digital to analog converter (DAC) 5, where the latter receives its input digital audio signal through an audio communication link 6. Although the DAC 5 and the amplifier 4 are shown as separate blocks, in one embodiment the electronic circuit components for these may be combined, not just for each driver but also for multiple drivers, in order to provide for a more efficient digital to analog conversion and amplification operation of the individual driver signals, e.g., using for example class D amplifier technologies.

The individual digital audio signal for each of the drivers 3 is delivered through an audio communication link 6, from a rendering processor 7. The rendering processor 7 may be implemented within a separate enclosure from the loudspeaker cabinet 2 (for example, as part of a computing device 18—see FIG. 5—which may be a smartphone, laptop computer, or desktop computer). In those instances, the audio communication link 6 is more likely to be a wireless digital communications link, such as a BLUETOOTH link or a wireless local area network link. In other instances however, the audio communication link 6 may be over a physical cable, such as a digital optical audio cable (e.g., a TOSLINK connection), or a high-definition multi-media interface (HDMI) cable. In another embodiment, the rendering processor 7 and the decision logic 8 are both implemented within the outer housing of the loudspeaker cabinet 2.

The rendering processor 7 is to receive a number of input audio channels of a piece of sound program content, depicted in the example of FIG. 1 as only a two channel input, namely left (L) and right (R) channels of a stereophonic recording. For example, the left and right input audio channels may be those of a musical work that has been recorded as only two channels. Alternatively, there may be more than two input audio channels, such as for example the entire audio soundtrack in 5.1-surround format of a motion picture film or movie intended for large public theater settings. These are to be converted into sound by the drivers 3, after the rendering processor transforms those input channels into the individual input drive signals to the drivers 3, in any one of several sound rendering modes of operation. The rendering processor 7 may be implemented as a programmed digital microprocessor entirely, or as a combination of a programmed processor and dedicated hard-wired digital circuits such as digital filter blocks and state machines. The rendering processor 7 may contain a beamformer that can be configured to produce the individual drive signals for the drivers 3 so as to "render" the audio content of the input audio channels as multiple, simultaneous, desired beams emitted by the drivers 3, as a beamforming loudspeaker array. The beams may be shaped and steered by the beamformer in accordance with a number of pre-configured rendering modes (as explained further below).

A rendering mode selection is made by decision logic 8. The decision logic 8 may be implemented as a programmed processor, e.g., by sharing the rendering processor 7 or by the programming of a different processor, executing a program that based on certain inputs, makes a decision as to which sound rendering mode to use, for a given piece of sound program content that is being or is to be played back, in accordance with which the rendering processor 7 will drive the loudspeaker drivers 3 (during playback of the piece of sound program content to produce the desired beams). More generally, the selected sound rendering mode can be changed during the playback automatically, based on changes in one or more of listener location, room acoustics, and, as explained further below, content analysis, as performed by the decision logic 8.

The decision logic 8 may automatically (that is without requiring immediate input from a user or listener of the audio system) change the rendering mode selection during the playback, based on changes in its decision logic inputs. In one embodiment, the decision logic inputs include one or both of sensor data and a user interface selection. The sensor data may include measurements taken by, for example a proximity sensor, an imaging camera such as a depth camera, or a directional sound pickup system, for example one that uses a microphone array. The sensor data and optionally the user interface selection (which may, for example, enable a listener to manually delineate the bounds of the room as well as the size and the location of furniture or other objects therein) may be used by a process of the decision logic 8, to compute a listener location, for example a radial position given by an angle relative to a front or forward axis of the loudspeaker cabinet 2. The user interface selection may indicate features of the room, for example the distance from the loudspeaker cabinet 2 to an adjacent wall, a ceiling, a window, or an object in the room such as a furniture piece. The sensor data may also be used, for example, to measure a sound refection value or a sound absorption value for the room or some feature in the room. More generally, the decision logic 8 may have the ability (including the digital signal processing algorithms) to evaluate interactions between the individual loudspeaker drivers 3 and the room, for example, to determine when the loudspeaker cabinet 2 has been placed close to an acoustically reflective surface. In such a case, and as explained below, an ambient beam (of the ambient-direct rendering mode) may be oriented at a different angle in order to promote the desired stereo enhancement or immersion effect.

The rendering processor 7 has several sound rendering modes of operation including two or more mid-side modes and at least one ambient-direct mode. The rendering processor 7 is thus pre-configured with such operating modes or has the ability to perform beamforming in such modes, so that the current operating mode can be selected and changed by the decision logic 8 in real time, during playback of the piece of sound program content. These modes are viewed as distinct stereo enhancements to the input audio channels (e.g., L and R) from which the system can choose, based on whichever is expected to have the best or highest impact on the listener in the particular room, and for the particular content that is being played back. An improved stereo effect or immersion in the room may thus be achieved. It may be expected that each of the different modes may have a distinct advantage (in terms of providing a more immersive stereo effect to the listener) not just based on the listener location and room acoustics, but also based on content analysis of the particular sound program content. In addition, these modes may be selected based on the understanding that, in one embodiment of the invention, all of the content above a lower cut-off frequency in all of available input audio channels of the piece of sound program content are to be converted into sound only by the drivers 3 in the loudspeaker cabinet 2. The drivers are treated as a loudspeaker array by the beam former which computes each individual driver signal based on knowledge of the physical location of the respective driver, relative to the other drivers. In other words, except for woofer and sub-woofer content (e.g., below 300 Hz), none of original audio content in the input audio channels will be sent to another loudspeaker of the system. This may be viewed as an audio system that has a single loudspeaker cabinet 2 (implementing a beamforming loudspeaker array for all content above a lower cut-off frequency).

In each of the mid-side modes of the rendering processor 7, the outputs of the rendering processor 7 may cause the loudspeaker drivers 3 to produce sound beams having (i) an omnidirectional pattern that includes a sum of two or more of the input audio channels, superimposed with (ii) a directional pattern that has a number of lobes where each lobe contains a difference of the two or more input channels. As an example, FIG. 2A depicts sound beams produced in such a mode, for the case of two input audio channels L and R (a stereo input). The loudspeaker cabinet 2 produces an omni beam 10 (having an omnidirectional pattern as shown) superimposed with a dipole beam 11. The omni beam 10 may be viewed as a monophonic down mix of a stereophonic (L, R) original. The dipole beam 11 is an example of a more directional pattern, having in this case two primary lobes where each lobe contains a difference of the two input channels L, R but with opposite polarities. In other words, the content being output in the lobe pointing to the right in the figure is L−R, while the content being output in the lobe pointing to the left of the dipole is −(L−R)=R−L. To produce such a combination of beams, the rendering processor 7 may have a beamformer that can produce a suitable, linear combination of a number pre-defined orthogonal modes, to produce the superposition of the omni beam 10 and the dipole beam 11. This beam combination results in the content being distributed within sectors of a general circle, as depicted in FIG. 2B which is in the view looking downward onto the horizontal plane of FIG. 2A in which the omni beam 10 and dipole beam 11 are drawn.

Figure 2B:
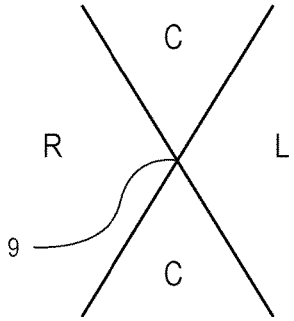
FIG. 2B shows the spatial variation in the rendered audio content, as a superposition of the sound beams of FIG. 2A, in a horizontal plane.

The resulting or combination sound beam pattern shown in FIG. 2B is referred to here as having a "stereo density" that is determined by the number of adjoining stereo sectors that span the 360 degrees shown (in the horizontal plane and around the center vertical axis 9 of the loudspeaker cabinet 2). Each stereo sector is composed of a center region C flanked by a left region L and a right region R. Thus, in the case of the mid-side mode depicted in FIG. 2B, the stereo density there is defined by only two adjoining stereo sectors, each having a separate and diametrically opposite center region C and each sharing a single left region L and a single right region R which are also diametrically opposed to each other. Each of these stereo sectors, or the content in each of these stereo sectors, is a result of the superposition of the omni beam 10 and the dipole beam 11 as seen in FIG. 2A. For example, the left region L is obtained as a sum of the L−R content in the right-pointing lobe of the dipole beam 11 and the L+R content of the omni beam 10, where here the quantity L+R is also named C.

Figure 3B:
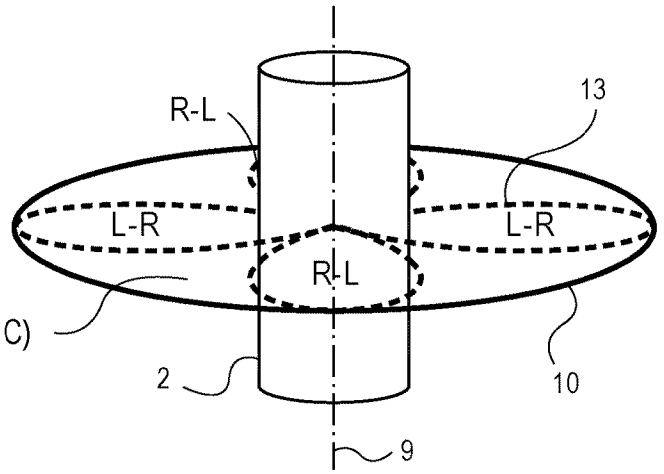
FIG. 3B shows the rendered beam content in the embodiment of FIG. 3A for the case of two input audio channels being available to form the beams.

Another way to view the dipole beam 11 depicted in FIG. 2A is as an example of a lower order mid-side rendering mode in which there are only two primary or main lobes in the directional pattern and each lobe contains a difference of the same two or more input channels, with the understanding that adjacent ones of these main lobes are of opposite polarity to each other. This generalization also covers the particular embodiment depicted in FIGS. 3A-3C in which the dipole beam 11 has been replaced with a quadrupole beam 13 in which there are 4 primary lobes in the directional pattern. This is a higher order beam pattern, as compared to the lower order beam pattern of FIGS. 2A-2B. The generalization still applies in this case, in that each lobe contains a difference of the two or more input channels (in this case L and R only, as seen in FIG. 3B) and where adjacent ones of the primary lobes are of opposite polarity to each other. Thus, looking at FIG. 3B, the front-pointing lobe whose content is R−L is adjacent to both a left pointing primary lobe having opposite polarity, L−R, and a right pointing primary lobe having also opposite polarity, L−R. Similarly, the rear pointing lobe (shown hidden behind the loudspeaker cabinet 2) has content R−L which is of opposite polarity to its two adjacent lobes (the same left and right pointing lobes having content L−R).

Figure 3A:
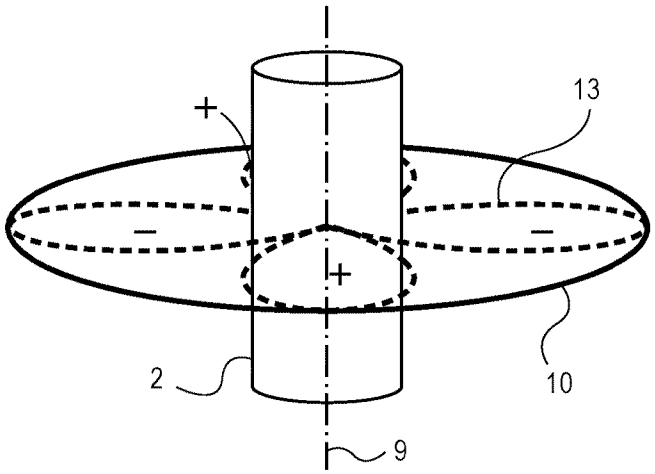
FIG. 3A is an elevation view of sound beam patterns produced by a higher order mid-side rendering mode.
Figure 3C:
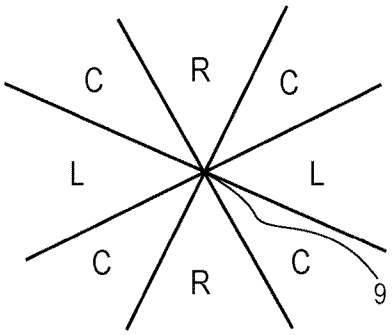
FIG. 3C shows the spatial variation in the horizontal plane of FIGS. 3A and 3B, of the rendered content that results from the superposition of the beams.

The high order mid-side mode depicted in FIGS. 3A-3B produces the combination or superposition sound beam pattern shown in FIG. 3C, in which there are four adjoining stereo sectors (that together span the 360 degrees around the center vertical axis 9 in the horizontal plane). Each stereo sector is, as explained above, composed of a center region C flanked by a left channel region L and a right channel region R. As in FIG. 2B, there is overlap between adjoining sectors, in that an L region is shared by two adjoining stereo sectors, as is an R region. Thus, there are four sectors in FIG. 3C which correspond to four center regions C each flanked by its L region and R region.

The above discussion expanded on the mid-side modes of the rendering processor 7, by giving an example of a low order mid-side mode in FIGS. 2A-2B (dipole beam 11) and an example of a high order mid-side mode in FIGS. 3A-3C (quadrupole beam 13). The high order mid-side mode has a beam pattern that has a greater directivity index or it may be viewed as having a greater number of primary lobes than the low order mid-side mode. Viewed another way, the various mid-side modes available in the rendering processor 7 produce sound beams patterns, respectively, of increasing order.

As explained above, the selection of a sound rendering mode may be a function of not just the current listener location and room acoustics, but also content analysis of the input audio channels. For instance, when the selection is based on content analysis of the piece of sound program content, the choice of a lower-order or a higher-order directional pattern (in one of the available mid-side modes) may be based on spectral and/or spatial characteristics of an input audio channel signal, such as the amount of ambient or diffuse sound (reverberation), the presence of a hard-panned (left or right) discrete source, or the prominence of vocal content. Such content analysis may be performed for example through audio signal processing of the input audio channels, upon predefined intervals for example one second or two second intervals, during playback. In addition, the content analysis may also be performed by evaluating the metadata associated with the piece of sound program content.

It should be noted that certain types of diffuse content benefit from being played back through a lower-order mid-side mode, which accentuates the spatial separation of uncorrelated content (in the room.) Other types of content that already contain a strong spatial separation, such as hard-panned discrete sources, may benefit from a higher-order mid-side mode, that produces a more uniform stereo experience around the loudspeaker. In the extreme case, a lowest order mid-side mode may be one in which there is essentially only the omni beam 10 being produced, without any directional beam such as the dipole beam 11, which may be appropriate when the sound content is purely monophonic. An example of that case is when computing the difference between the two input channels, R−L (or L−R) results in essentially zero or very little signal components.

Figure 4:
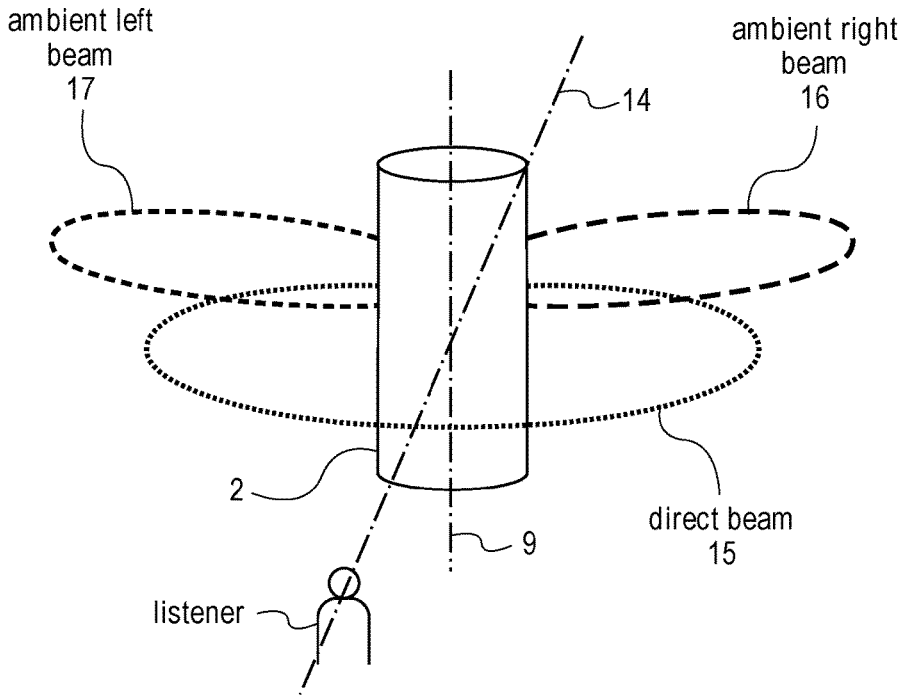
FIG. 4 depicts an elevation view of an example of the sound beam patterns produced in an ambient-direct mode.

Turning now to FIG. 4, this figure depicts an elevation view of the sound beam patterns produced in an example of the ambient-direct rendering mode. Here, the outputs of a beamformer in the rendering processor 7 (see FIG. 1) cause the loudspeaker drivers 3 of the array to produce sound beams having (i) a direct content pattern (direct beam 15), superimposed with (ii) an ambient content pattern that is more directional than the direct content pattern (here, ambient right beam 16 and ambient left beam 17). The direct beam 15 may be aimed at a previously determined listener axis 14, while the ambient beams 16, 17 are aimed away from the listener axis 14. The listener axis 14 represents the current location of the listener, or the current listening position (relative to the loudspeaker cabinet 2.) The location of the listener may have been computed by the decision logic 8, for example as an angle relative to a front axis (not shown) of the loudspeaker cabinet 2, using any suitable combination of its inputs including sensor data and user interface selections. Note that the direct beam 15 may not be omnidirectional, but is directional (as are each of the ambient beams 16, 17.) Also, certain parameters of the ambient-direct mode may be variable (e.g., beam width and angle) dependent on audio content, room acoustics, and loudspeaker placement.

The decision logic 8 analyzes the input audio channels, for example using time-windowed correlation, to find correlated content and uncorrelated (or de-correlated) content therein. For example, the L and R input audio channels may be analyzed, to determine how correlated any intervals or segments in the two channels (audio signals) are relative to each other. Such analysis may reveal that a particular audio segment that effectively appears in both of the input audio channels is a genuine, "dry" center image, with a dry left channel and a dry right channel that are in phase with each other; in contrast, another segment may be detected that is considered to be more "ambient" where, in terms of the correlation analysis, an ambient segment is less transient than a dry center image and also appears in the difference computation L−R (or R−L). As a result, the ambient segment should be rendered as diffuse sound by the audio system, by reproducing such a segment only within the directional pattern of the ambient right beam 16 and the ambient left beam 17, where those ambient beams 16, 17 are aimed away from the listener so that the audio content therein (referred to as ambient or diffuse content) can bounce off of the walls of the room (see also FIG. 1). In other words, the correlated content is rendered in the direct beam 15 (having a direct content pattern), while the uncorrelated content is rendered in the, for example, ambient right beam 16 and ambient left beam 17 (which have ambient content patterns.)

Another example of ambient content is a recorded reverberation of a voice. In that case, the decision logic 8 detects a direct voice segment in the input audio channels, and then signals the rendering processor 7 to render that segment in the direct beam 15. The decision logic 8 may also detect a reverberation of that direct voice segment, and a segment containing that reverberation is also extracted from the input audio channels and, in one embodiment, is then rendered only through the side-firing (more directional and aimed away from the listener axis 14) ambient right beam 16 and ambient left beam 17. In this manner, the reverberation of the direct voice will reach the listener via an indirect path thereby providing a more immersive experience for the listener. In other words, the direct beam 15 in that case should not contain the extracted reverberation but should only contain the direct voice segment, while the reverberation is relegated to only the more directional and side-firing ambient right beam 16 and ambient left beam 17.

To summarize, an embodiment of the invention is a technique that attempts to re-package an original audio recording so as to enhance the reproduction or playback in a particular room, in view of room acoustics, listener location, and the direct versus ambient nature of content within the original recording. The capabilities of the decision logic 8, in terms of content analysis, listener location or listening position determination, and room acoustics determination, and the capabilities of the beamformer in the rendering processor 7, may be implemented by a processor that is executing instructions stored within a machine-readable medium. The machine-readable medium (e.g., any form of solid state digital memory) together with the processor may be housed within a separately-housed computing device 18 (see the room depicted in FIG. 5), or they may be contained within the loudspeaker cabinet 2 of the audio system (see also FIG. 1). The so-programmed processor receives the input audio channels of a piece of sound program content, for example via streaming of a music or movie file over the Internet from a remote server. It also receives one or both of sensor data and a user interface selection, that indicates or is indicative of (e.g., represents or is defined by) either room acoustics or a location of a listener. It also performs content analysis upon the piece of sound program content. One of several sound rendering modes is selected, for example based on a current combination of listener location and room acoustics, in accordance with which playback of the sound program content occurs through a loudspeaker array. The rendering mode can be changed automatically, based on changes in listener location, room acoustics, or content analysis. The sound rendering modes may include a number of mid-side modes and at least one ambient-direct mode. In the mid-side modes, the loudspeaker array produces sound beam patterns, respectively, of increasing order. In the ambient-direct mode, the loudspeaker array produces sound beams having a superposition of a direct content pattern (direct beam) and an ambient content pattern (one or more ambient beams). The content analysis causes correlated content and uncorrelated content to be extracted from the original recording (the input audio channels.)

In one embodiment, when the rendering processor has been configured into its ambient-direct mode of operation, the correlated content is rendered only in the direct content pattern of a direct beam, while the uncorrelated content is rendered only in the ambient content pattern of one or more ambient beams.

In the case where the rendering processor has been configured into one of its mid-side modes of operation, a low order directional pattern is selected when the sound program content is predominately ambient or diffuse, while a high order directional pattern is selected when the sound program content contains mostly panned sound. This selection between the different mid-side modes may occur dynamically during playback of the piece of sound program content, be it a musical work, or an audio-visual work such as a motion picture film.

The above-described techniques may be particularly effective in the case where the audio system relies primarily on a single loudspeaker cabinet (having the loudspeaker array housed within), where in that case all content above a cut-off frequency, such as less than or equal to 500 Hz (e.g., 300 Hz), in all of the input audio channels of the piece of sound program content, are to be converted into sound only by the loudspeaker cabinet. This provides an elegant solution to the problem of how to obtain immersive playback using a very limited number of loudspeaker cabinets, for example just one, which may be particularly desirable for use in a small room (in contrast to a public movie theater or other larger sound venue.)

Figure 5:
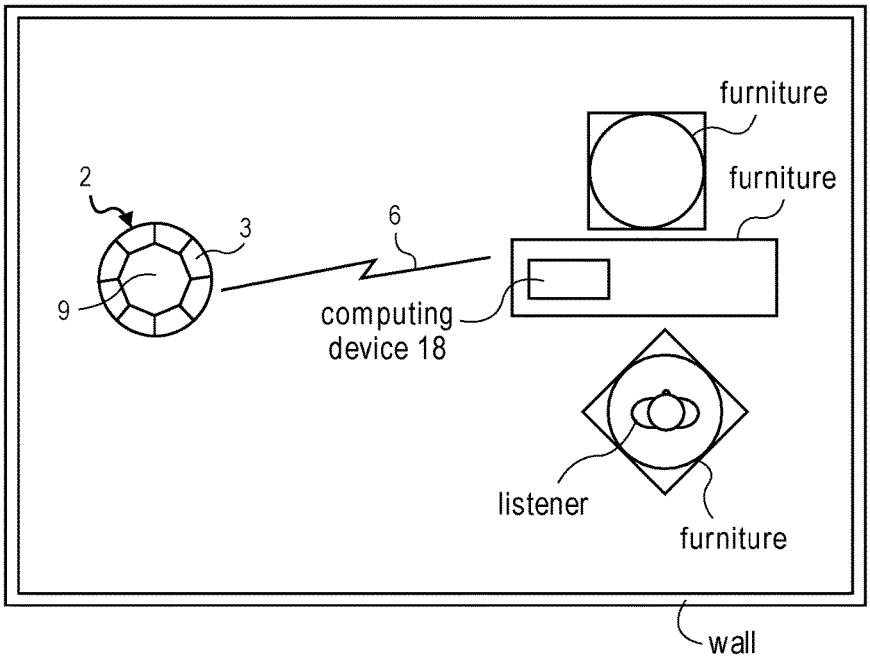
FIG. 5 is a downward view onto a horizontal plane of a room in which the audio system is operating.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, FIG. 5 depicts the audio system as a combination of the computing device 18 and the loudspeaker cabinet 2 in the same room, with several pieces of furniture and a listener. Although in this case there is just a single instance of the loudspeaker cabinet 2 communicating with the computing device 18, in other cases there may be additional loudspeaker cabinets that are communicating with the computing device 18 during the playback (e.g., a woofer and a subwoofer that are receiving the audio content that is below the lower cut-off frequency of the loudspeaker array.) The description is thus to be regarded as illustrative instead of limiting.

What is claimed is:

1. An audio system having a loudspeaker array, comprising:

a loudspeaker cabinet, having integrated therein a plurality of loudspeaker drivers;

a plurality of audio amplifiers whose outputs are coupled to inputs of the plurality of loudspeaker drivers;

a rendering processor to receive a plurality of input audio channels of a piece of sound program content that is to be converted into sound by the loudspeaker drivers, the rendering processor having outputs that are coupled to inputs of the plurality of audio amplifiers, the rendering processor having a plurality of sound rendering modes of operation that include a) a first mode and b) a second mode; and a decision processor to receive input data that are indicative of one of i) a feature of a room or ii) a listening position, and in response to the input data, change a rendering mode selection of one of the plurality of sound rendering modes of operation during playback of the piece of sound program content, which then changes a way the rendering processor drives the loudspeaker drivers during the playback, wherein, in the first mode of the rendering, processor, the outputs of the rendering processor cause the plurality of loudspeaker drivers to produce sound beams having i) omni-directional pattern superimposed with ii) a directional pattern that has a plurality of lobes, wherein, in the second mode of the rendering processor, the outputs of the rendering processor cause the plurality of loudspeaker drivers to produce sound beams having i) a direct content pattern that is aimed at the listening position, superimposed with ii) an ambient content pattern that is aimed away from the listening position.

2. The audio system of claim 1 wherein all content above 500 Hz is to be converted into sound by the plurality of drivers in the loudspeaker cabinet.

3. The audio system of claim 2 wherein the plurality of drivers in the loudspeaker cabinet are more numerous than the plurality of input audio channels of the piece of sound program content.

4. The audio system of claim 1 wherein in the first mode of the rendering processor, each lobe of the plurality of lobes in the directional pattern contains a difference between the two or more input audio channels, and adjacent lobos of said plurality of lobes are of opposite polarity to each other.

5. The audio system of claim 1 wherein the decision processor is to analyze the, plurality of input audio channels to find correlated content and uncorrelated content, wherein the correlated content is then rendered in the direct content pattern while the uncorrelated content is rendered in the ambient content pattern.

6. The audio system of claim 1 wherein the piece of sound program content is a sound track of a motion picture film, and the plurality of input audio channels are all audio channels of the sound track.

7. A process for reproducing sound using a loudspeaker array that is housed in a loudspeaker cabinet, comprising:

receiving a plurality of input audio channels of a piece of sound program content that is to be convened into sound by the loudspeaker array housed in the loudspeaker cabinet;

receiving input data that indicates one of i) a feature of a room or ii) a listening position;

selecting one of a plurality of sound rendering, modes in accordance with which playback of the piece of sound program content occurs through the loudspeaker array, and changing the selected sound rendering mode based on changes in the input data during the playback, wherein the plurality of sound rendering modes include a) a plurality of first modes and b) a second mode, wherein in each of the plurality of first modes, the loudspeaker array produces sound beams having i) a first pattern that includes a sum of two or more of the plurality of input audio channels, superimposed with ii) a second pattern that has a plurality of lobes each lobe containing a difference of the two or more input audio channels, and wherein in the second mode, the loudspeaker array produces sound beams having i) direct content pattern that is aimed at the listening position, superimposed with ii) an ambient content pattern that is aimed away from the listening position.

8. The process of claim 7 wherein selecting one of the sound rendering modes is based on analyzing the piece of sound program content, wherein one of the plurality of first modes that has a low order directional pattern is selected when the sound program content is predominantly ambient or diffuse sound, and wherein one of the plurality of first modes that has a high order directional pattern is selected when the sound program content contains panned sound.

9. The process of claim 8 wherein analyzing the piece of sound program content comprises analyzing the plurality of input audio channels to find correlated content and uncorrelated content, and wherein in the second mode the correlated content is rendered in the direct content pattern and not in the ambient content pattern, while the uncorrelated content is rendered in the ambient content pattern and not in the direct content pattern.

10. The process of claim 7 wherein all content above a frequency that is less than 500 Hz, in all of the plurality of input audio channels of the piece of sound program content, are to be converted into sound by the loudspeaker array housed in the loudspeaker cabinet.

11. The process of claim 10 wherein a number of drivers in the loudspeaker array used to convert the piece of sound program content into sound are more numerous than the plurality of input audio channels of the piece of sound program content.

12. The process of claim 7 wherein in each of the plurality of first modes, each lobe of the plurality of lobes in the directional pattern contains a difference of the two or more input channels, and adjacent lobes of said plurality of lobes are of opposite polarity to each other.

13. The process of claim 7 wherein the plurality of first modes comprise a low order first mode and a high order first mode, wherein, the high order first mode has a beam pattern that has a greater directivity index or a greater number of lobes than the low order first mode.

14. An article of manufacture comprising a non-transitory machine- readable medium having instructions stored therein that when executed by a processor receive a plurality of input audio channels of a piece of sound program content that is to be converted into sound by a loudspeaker array housed in a loudspeaker cabinet, receive input data that indicates one of room acoustics or a location of a listener, perform content analysis upon the piece of sound program content, select one of a plurality of sound rendering modes in accordance with which playback of the piece of sound program content occurs through the loudspeaker array, and change the selected sound rendering mode during the playback based on changes in one or more of the listener location, the room acoustic, or the content analysis, wherein the plurality of sound rendering modes include a) a plurality of first modes and b) a second mode, wherein in the plurality of first modes, the loudspeaker array is to produce a plurality of sound beam patterns of different order, and wherein in the second mode, the loudspeaker array is to produce sound beams having i) a direct content pattern that is aimed at the listener location, superimposed with ii) an ambient content pattern that is aimed away from the listener location.

15. The article of manufacture of claim 14 wherein the non-transitory machine-readable medium has instructions stored therein that when executed by the processor produce the plurality of sound beam patterns as having increasing stereo density, respectively, wherein each of the plurality of sound beam patterns includes a plurality of adjoining stereo sectors that span 360 degrees and where each stereo sector is composed of a center channel region flanked by a left channel region and a right channel region.

16. The article of manufacture of claim 14 wherein when selecting one of the sound rendering modes based on the content analysis of the piece of sound program content, one of die plurality of first modes that has a low order directional pattern is selected when the sound program content is predominantly ambient or diffuse sound, and wherein one of the plurality of first modes that has a high order directional pattern is selected when the sound program content contains panned sound.

17. The article of manufacture of claim 14 wherein the content analysis of the piece of sound program content comprises analyzing the plurality of input audio channels to find correlated content and uncorrelated content, and wherein in the second mode the correlated content is rendered in the direct content pattern while the uncorrelated content is rendered in the ambient content pattern.

18. The article of manufacture of claim 14 wherein all content above a frequency that is less than 500 Hz, in all of the plurality of input audio channels of the piece of sound program content, are to be converted into sound by the loudspeaker array housed in the loudspeaker cabinet.

19. The article of manufacture of claim 14 wherein the non-transitory machine-readable medium has instructions stored therein that when executed by the processor define a number of drivers in the loudspeaker array, that are used to convert the piece of sound program content into sound, as being more numerous than the plurality of input audio channels of the piece of sound program content.

* * * * *